US007688163B2

(12) United States Patent
Machida

(10) Patent No.: US 7,688,163 B2
(45) Date of Patent: Mar. 30, 2010

(54) PILLBOX VACUUM WINDOW

(75) Inventor: Tetsuo Machida, Kanagawa (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 93 days.

(21) Appl. No.: 11/734,107

(22) Filed: Apr. 11, 2007

(65) Prior Publication Data

US 2007/0241845 A1 Oct. 18, 2007

(30) Foreign Application Priority Data

Apr. 13, 2006 (JP) ..... 2006-110806

(51) Int. Cl.
*H01P 1/08* (2006.01)

(52) U.S. Cl. ..... 333/252; 315/39

(58) Field of Classification Search ..... 333/252, 333/254; 315/39

See application file for complete search history.

(56) References Cited

U.S. PATENT DOCUMENTS 2,422,189 A * 6/1947 Fiske ..... 333/252
3,210,699 A * 10/1965 Tagano ..... 333/252
3,781,726 A * 12/1973 Thompson ..... 333/252
5,136,272 A * 8/1992 Kormann et al. ..... 333/252

FOREIGN PATENT DOCUMENTS

JP 4-92341 A 3/1992
JP 8-154001 A 6/1996

* cited by examiner

*Primary Examiner*—Benny Lee
(74) *Attorney, Agent, or Firm*—Sughrue Mion, PLLC

(57) ABSTRACT

A pillbox vacuum window of the present invention has a first metal part and a second metal part. The first metal part includes a ceramic disk formed with a metallization layer in a peripheral area thereof, a larger diameter cylindrical portion, and a smaller diameter cylindrical portion having an inner diameter smaller than that of the larger diameter cylindrical portion, and coupled to the larger diameter cylindrical portion to form a step section at a joint, where the ceramic disk is fitted into the step section. The second metal part includes a cylindrical portion, where the cylindrical portion is inserted into the step section of the first metal part while the ceramic disk is placed in the step section of the first metal part.

10 Claims, 7 Drawing Sheets

PILLBOX VACUUM WINDOW

This application is based upon and claims the benefit of priority from Japanese Patent Application No. 2006-110806 filed on Apr. 13, 2006, the content of which is incorporated by reference.

BACKGROUND OF THE INVENTION

1. Field of the Invention

The present invention relates to a pillbox vacuum window for use in a microwave tube as input/output windows, and a method of manufacturing the pillbox vacuum window.

2. Description of the Related Art

FIG. 1 is a cross-sectional view illustrating the structure of a general microwave tube.

Referring to FIG. 1, the microwave tube comprises electron gun 31 for emitting electron beams, high frequency circuit 32 for interacting an RF signal (microwave) received thereby with an electron beam emitted from electron gun 31 to amplify and deliver the resulting electron beam, collector 33 for collecting the electron beam which has passed through high frequency circuit 32, and anode electrode 34 for guiding the electron beam emitted from electron gun 31 into high frequency circuit 32.

The microwave tube also comprises pillbox vacuum windows 35, 36 as input/output windows of the RF signal for two purposes, i.e., for reducing the RF signal loss and for sealing the microwave tube in a vacuum.

Techniques related to the pillbox vacuum windows are disclosed, for example, in JP-A-04-092341 and JP-A-08-154001.

The following description will be focused on the configuration of a conventional pillbox vacuum window.

FIG. 2A is a longitudinal sectional view illustrating an exemplary configuration of a conventional pillbox window, and FIG. 2B is a cross-sectional view illustrating an exemplary configuration of the conventional pillbox vacuum window.

Referring to FIG. 2A, the illustrated exemplary conventional pillbox vacuum window comprises ceramic disk 41, metallization layer 42, and metal parts 43, 44.

Ceramic disk 41 is positioned at the center of the pillbox vacuum window.

Metallization layer 42 is formed on the peripheral side surface of ceramic disk 41 and on the peripheral areas of both plane surfaces of the same.

Metal parts 43, 44 are bonded to ceramic disk 41 by brazing through metallization layer 42 so as to sandwich ceramic disk 41 therebetween from both plane surfaces of ceramic disk 41.

Metallization layer 42 is required to have a length equal to or larger than a leak path in order to prevent a leak between ceramic disk 41 and metal parts 43, 44.

The leak path refers to the length of portions of ceramic disk 41 and metal parts 43, 44 which are bonded to each other through metallization layer 42.

In this conventional example, the leak path has radial length L of 0.5 mm on both plane surfaces of ceramic disk 41. Accordingly, metallization layers 42 on both plane surfaces of ceramic disk 41 also have a radial length of 0.5 mm or larger.

In this conventional example, ceramic disk 41 has thickness t of 0.2 mm, cylindrical waveguide pipe 45 has a cylindrical cavity, the inner diameter R (FIG. 2B) of which is 4 mm, and square waveguide pipes 46*a*, 46*b* (FIG. 2A) each have a long side a (FIG. 2B) of 7.11 mm and a short side b (FIG. 2B) of 3.56 mm.

FIG. 3A is a longitudinal sectional view illustrating another exemplary configuration of a conventional pillbox vacuum window, and FIG. 3B is a cross-sectional view illustrating another exemplary configuration of the exemplary conventional pillbox vacuum window.

Referring to FIG. 3A, the pillbox vacuum window of this conventional example comprises ceramic disk 51, metallization layer 52, and metal parts 53, 54, 55.

Ceramic disk 51 is positioned at the center of the pillbox vacuum window.

Metallization layer 52 is formed on the peripheral side surface of ceramic disk 51.

Metal part 55 is bonded to ceramic disk 51 by brazing through metallization layer 52 to sandwich ceramic disk 51 from the peripheral side surface of ceramic disk 51.

Metal parts 53, 54 are bonded to metal part 55 by brazing to sandwich metal part 55 therebetween from both plane surfaces of ceramic disk 51.

In this conventional example, ceramic disk 51 has thickness t of 0.4 mm. Accordingly, a leak path also has a length of 0.4 mm in the thickness direction, and metallization layer 52 also has a length of 0.4 mm in the thickness direction on the peripheral side surface of ceramic disk 51.

In this conventional example, cylindrical waveguide 56 has a cylindrical cavity, the inner diameter R (FIG. 3B) of which is 4 mm, while square waveguides 57*a*, 57*b* (FIG. 3A) each have a long side a (FIG. 3B) of 7.11 mm, and a short side b (FIG. 3B) of 3.56 mm.

FIG. 4 is a graph for describing the voltage standing wave ratio (hereinafter called "VSWR") vs. frequency (in GHz) of the conventional pillbox vacuum window illustrated in FIGS. 2A and 2B.

In the conventional pillbox vacuum window illustrated in FIGS. 2A and 2B, metallization layer 42 is required to have a radial length of 0.5 mm or larger on both plane surfaces of ceramic disk 41. As metallization layer 42 has a larger length in this way, resonance occurs in a peripheral area of ceramic disk 41 at around 37 GHz within an available frequency band (26.5 to 40.0 GHz) of the pillbox vacuum window, giving rise to an abrupt rise of VSWR, as shown in FIG. 4.

Also, in the conventional pillbox vacuum window illustrated in FIGS. 2A and 2B, ceramic disk 41 must be increased in outer diameter more than is necessary, together with metallization layer 42 which is formed to have a length of 0.5 mm or more. Ceramic disk 41 is made of a dielectric material such as alumina, beryllia or the like. Accordingly, the larger outer diameter of ceramic disk 41 results in a higher proportion of dielectric material which occupies the overall pillbox vacuum window, causing the dielectric material to exert a larger influence on the VSWR characteristics. Consequently, as shown in FIG. 4, VSWR is increased due to the influence of the dielectric material at around 35 GHz within the available frequency band of the pillbox vacuum window.

Likewise, in the conventional pillbox vacuum window illustrated in FIGS. 3A and 3B, ceramic disk 51 is required to have a thickness of 0.4 mm, so that ceramic disk 51 must be made thicker than is necessary. Also, a larger thickness of ceramic disk 51 results in a larger length of metallization layer 52 in the thickness direction. Accordingly, the VSWR characteristics are similar to those shown in FIG. 4 in that resonance occurs within an available frequency band to increase VSWR.

Also, the conventional pillbox vacuum window illustrated in FIGS. 3A and 3B has the problem that it is difficult to maintain the dimensional accuracy for each part during brazing.

SUMMARY OF THE INVENTION

It is therefore an object of the present invention to provide a pillbox vacuum window which is capable of exhibiting stable VSWR characteristics within an available frequency band and is also capable of maintaining an appropriate dimensional accuracy for each part, and a method of manufacturing the pillbox vacuum window.

To achieve the above object, a pillbox vacuum window of the present invention is characterized by comprising:

a ceramic disk having a metallization layer formed in a peripheral area thereof;

a first metal part including a larger diameter cylindrical portion, and a smaller diameter cylindrical portion having an inner diameter smaller than that of said larger diameter cylindrical part, and coupled to said larger diameter cylindrical part to form a step section at a joint, said ceramic disk being fitted into the step section; and a second metal part including a cylindrical portion being inserted into the step section of said first metal part while said ceramic disk is placed in the step section of said first metal part.

Also, to achieve the above object, a method of manufacturing a pillbox vacuum window of the present invention is characterized by comprising the steps of:

providing a first metal part which includes a larger diameter cylindrical portion having an inner diameter substantially identical to the outer diameter of a ceramic disk formed with a metallization layer in a peripheral area thereof, and a smaller diameter cylindrical portion having an inner diameter smaller than that of said larger diameter cylindrical portion, and coupled to said larger diameter cylindrical portion to form a step section at a joint;

providing a second metal part which includes a cylindrical portion having an outer diameter substantially identical to the outer diameter of said ceramic disk; and inserting the cylindrical portion of said second metal part into the step section of said first metal part so as to sandwich said ceramic disk.

According to the pillbox vacuum window of the present invention, the cylindrical portion of the second metal part is inserted into the step section of the first metal part while the ceramic disk is placed in the step section of the first metal part.

Consequently, the leak path, which extends along the length of portions of the ceramic disk and the first metal part and the second metal part which are bonded to each other through the metallization layer, can be shorted. In this way, the lengths of the metallization layer can be reduced in the radial and thickness directions, thus making it possible to avoid resonance which would otherwise occur in a peripheral area of the ceramic disk within an available frequency band.

Also, since the lengths of the metallization layer can be reduced in the radial and thickness direction, the ceramic disk need not be increased in diameter or thickness more than is necessary. This can reduce the proportion of dielectric material which occupies the overall pillbox vacuum window, leading to the avoidance of an increase in VSWR within the available frequency range, due to the influence of the dielectric material.

As a result, stable VSWR characteristics can be achieved within the available frequency range of the pillbox vacuum window.

Further, since the pillbox vacuum window of the present invention is configured such that the cylindrical portion of the second metal part is inserted into the step section of the first metal part while the ceramic disk is placed in the step section of the first metal part, the thin ceramic disk can be fixed with high accuracy. In addition, since the second metal part is also accurately inserted into the first metal part, appropriate dimensional accuracy can be maintained for each part.

The above and other objects, features, and advantages of the present invention will become apparent from the following description with reference to the accompanying drawings which illustrate examples of the present invention, wherein like numerals refer to like parts throughout.

DETAILED DESCRIPTION OF THE INVENTION

Figure 1:
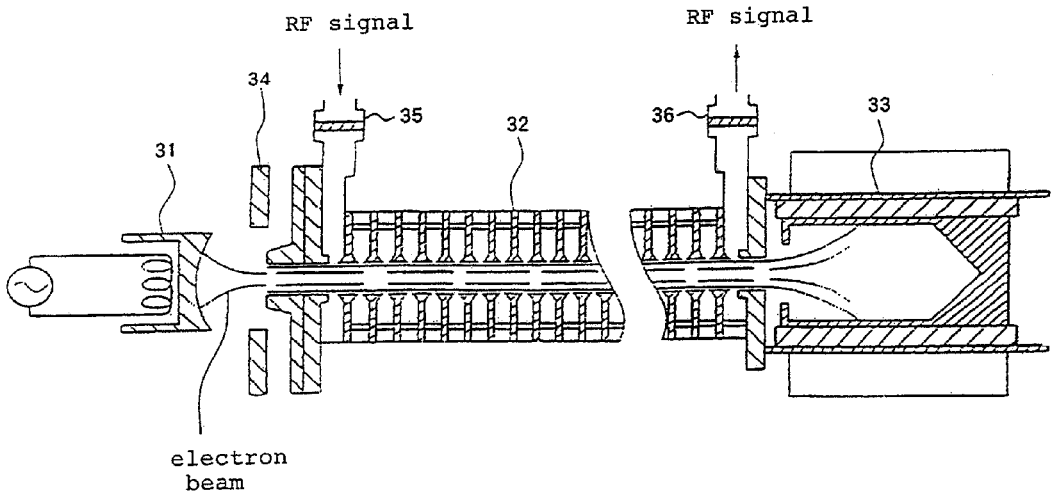
FIG. 1 is a cross-sectional view illustrating the structure of a general microwave tube.
Figure 2A:
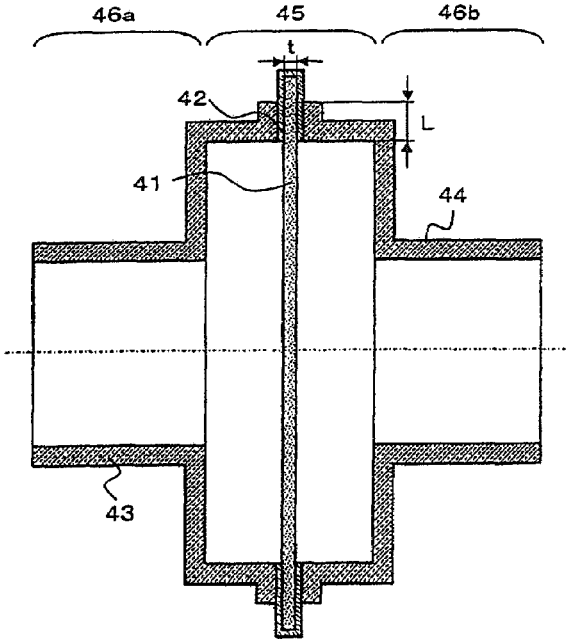
FIG. 2A is a longitudinal sectional view illustrating an exemplary configuration of a conventional pillbox vacuum window.
Figure 2B:
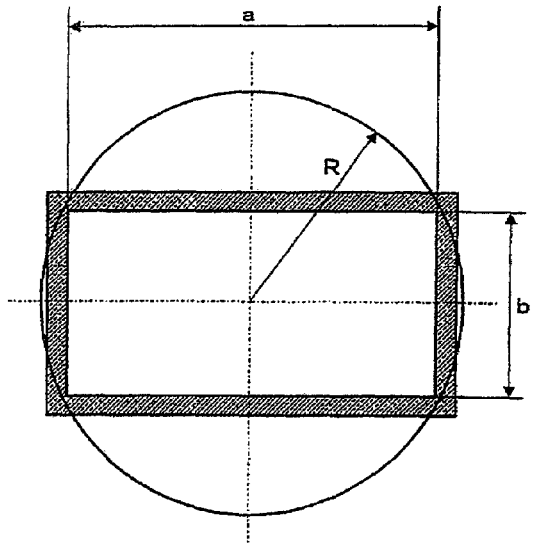
FIG. 2B is a cross-sectional view illustrating an exemplary configuration of the conventional pillbox vacuum window.
Figure 3A:
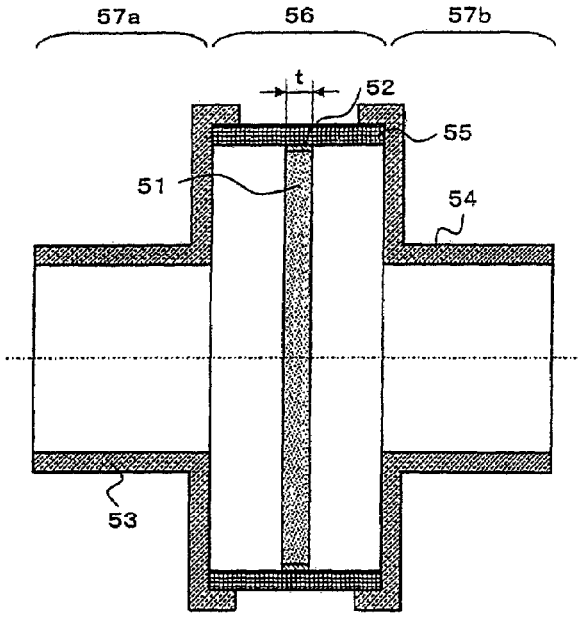
FIG. 3A is a longitudinal sectional view illustrating another exemplary configuration of a conventional pillbox vacuum window.
Figure 3B:
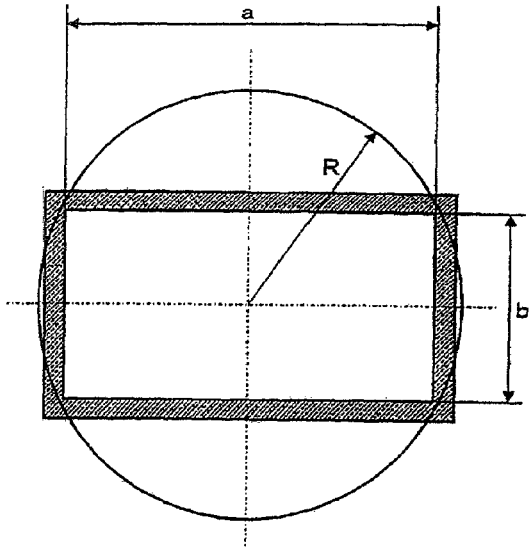
FIG. 3B is a cross-sectional view illustrating another exemplary configuration of the conventional pillbox vacuum window.
Figure 4:
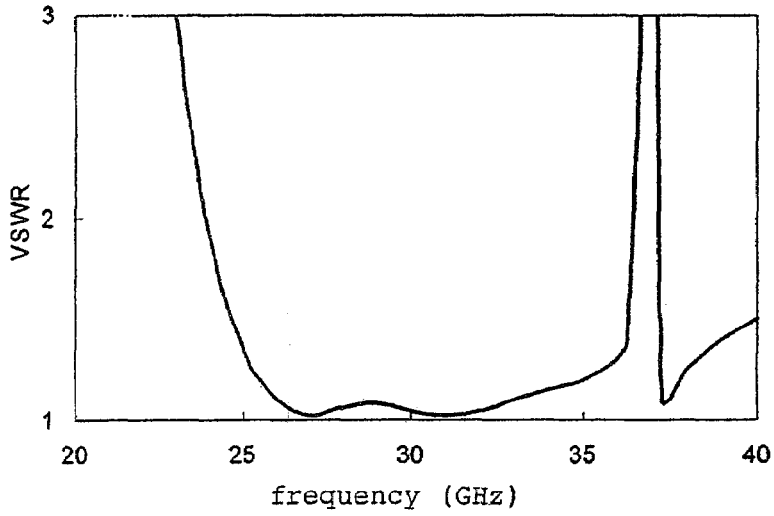
FIG. 4 is a graph for describing the VSWR characteristics of the pillbox vacuum window illustrated in FIGS. 2A and 2B.
Figure 5B:
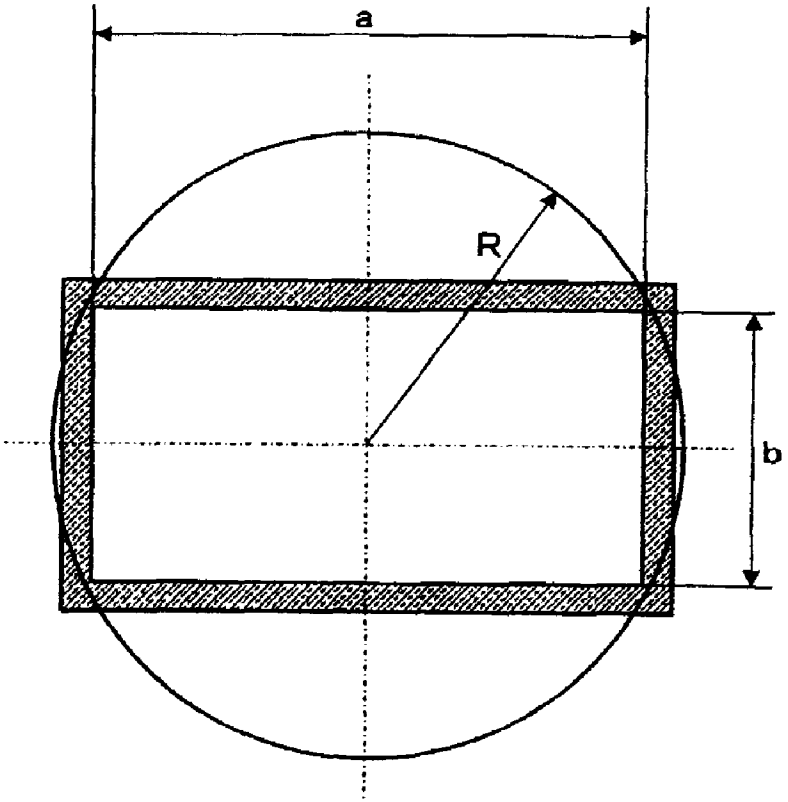
FIG. 5B is a cross-sectional view illustrating the configuration of the pillbox vacuum window according to the embodiment of the present invention.
Figure 5A:
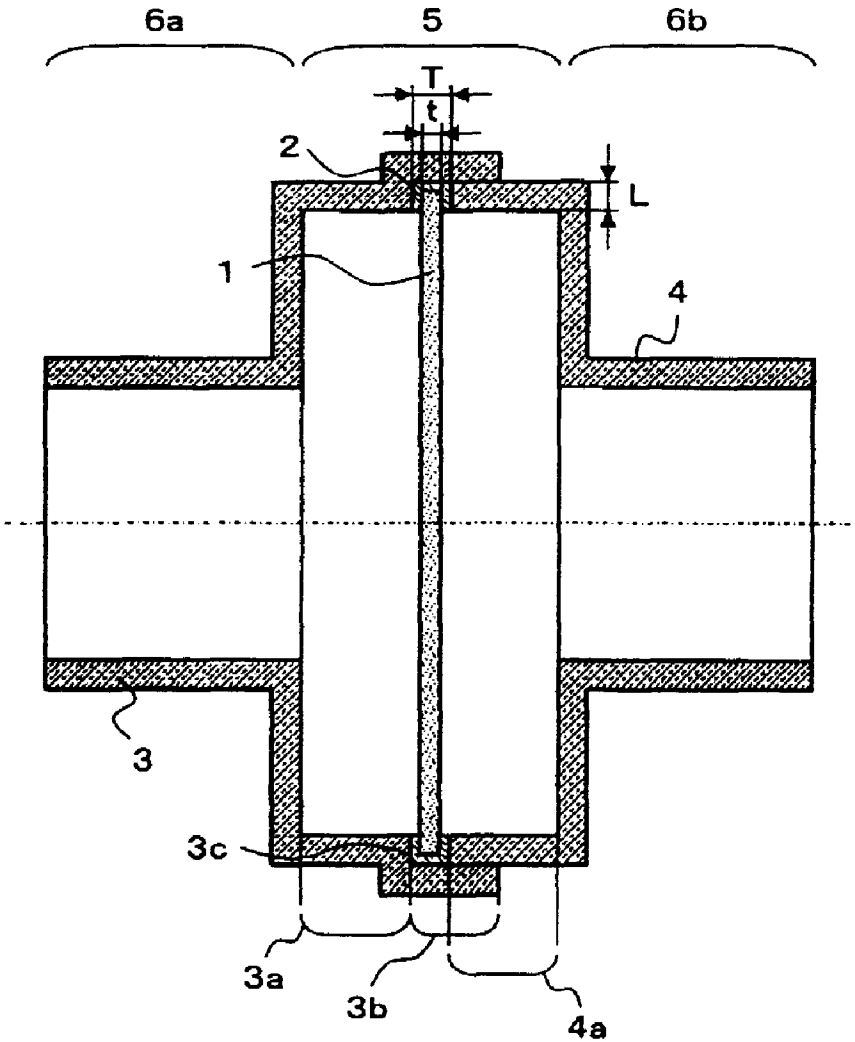
FIG. 5A is a longitudinal sectional view illustrating the configuration of a pillbox vacuum window according to one embodiment of the present invention.

FIG. 5A is a longitudinal sectional view illustrating the configuration of a pillbox vacuum window according to one embodiment of the present invention, and FIG. 5B is a cross-sectional view illustrating the configuration of the pillbox vacuum window according to the embodiment of the present invention.

Referring to FIG. 5A, the pillbox vacuum window of this embodiment comprises ceramic disk 1, metallization layer 2, metal part 3 which is a first metal part, and metal part 4 which is a second metal part.

Ceramic disk 1 is positioned at the center of the pillbox vacuum window.

Metallization layer 2 is formed on the peripheral side surface of ceramic disk 1 and on the peripheral areas of both plane surfaces of the same.

Metal part 3 has a portion which defines square waveguide 6*a* and the other portion which defines cylindrical waveguide 5. The portion which defines cylindrical waveguide 5 includes larger diameter cylindrical portion 3*a* which has an inner diameter substantially identical to the outer diameter of ceramic disk 1, and smaller diameter portion 3*b* which has an inner diameter smaller than that of larger diameter cylindrical portion 3*a*, is coupled to larger diameter cylindrical portion 3*a*, and is formed at a joint with portion 3*a* to form step section 3*c*. Ceramic disk 1 is fitted into this step section 3*c*.

Metal part 4 has a portion which defines square waveguide 6*b*, and the other portion which defines cylindrical waveguide 5. The portion which defines cylindrical waveguide 5 includes cylindrical portion 4*a* which has an outer diameter substantially identical to the outer diameter of ceramic disk 1. This cylindrical portion 4*a* is inserted into step section 3*c* of metal part 3 while ceramic disk 1 is placed in step section 3*c* of metal part 3.

Now, a description will be given of a method of manufacturing the pillbox vacuum window of this embodiment.

Figure 6A:
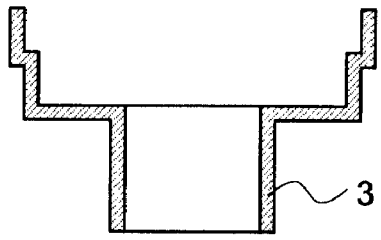
FIG. 6A is a cross-sectional view illustrating a method of manufacturing a pillbox vacuum window illustrated in FIGS. 5A and 5B.

Referring to FIG. 6A, first, metal part 3 is provided.

Figure 6B:
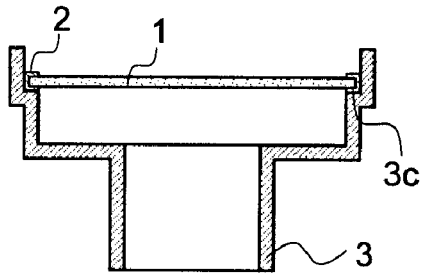
FIG. 6B is a cross-sectional view illustrating a method of manufacturing a pillbox vacuum window illustrated in FIGS. 5A and 5B.

Referring to FIG. 6B, next, ceramic disk 1 that is formed with metallization layer 2 around the periphery is fitted into step section 3*c* of metal part 3, and ceramic disk 1 is bonded to metal part 3 by brazing through metallization layer 2.

Figure 6C:
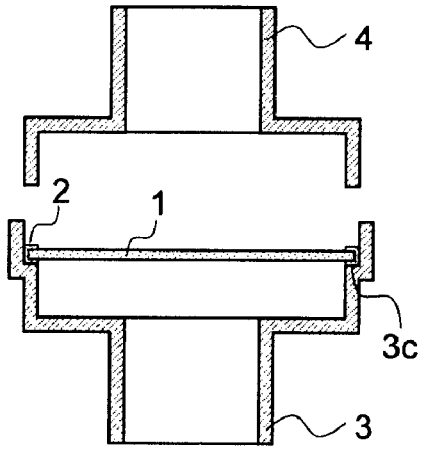
FIG. 6C is a cross-sectional view illustrating a method of manufacturing a pillbox vacuum window illustrated in FIGS. 5A and 5B.

Referring to FIG. 6C, next, metal part 4 is provided.

Figure 6D:
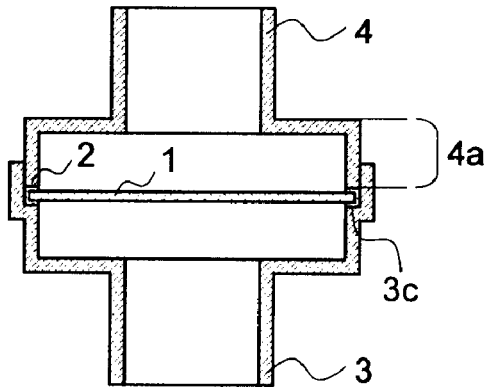
FIG. 6D is a cross-sectional view illustrating a method of manufacturing a pillbox vacuum window illustrated in FIGS. 5A and 5B.

Referring to FIG. 6D, subsequently, while ceramic disk 1 is placed in step section 3*c* of metal part 3, cylindrical portion 4*a* of metal part 3 is inserted into step section 3*c* of metal part 3, and metal part 3 is bonded to ceramic disk 1 by brazing through metallization layer 2.

In this embodiment, ceramic disk 1 has thickness t (FIG. 5A) of 0.2 mm, cylindrical waveguide 5 has a cylindrical cavity, the inner diameter R (FIG. 5B) of which is 4 mm, and square waveguides 6*a*, 6*b* (FIG. 5A) each have a long side a (FIG. 5B) of 7.11 mm and a short side b (FIG. 5B) of 3.56 mm.

Figure 7:
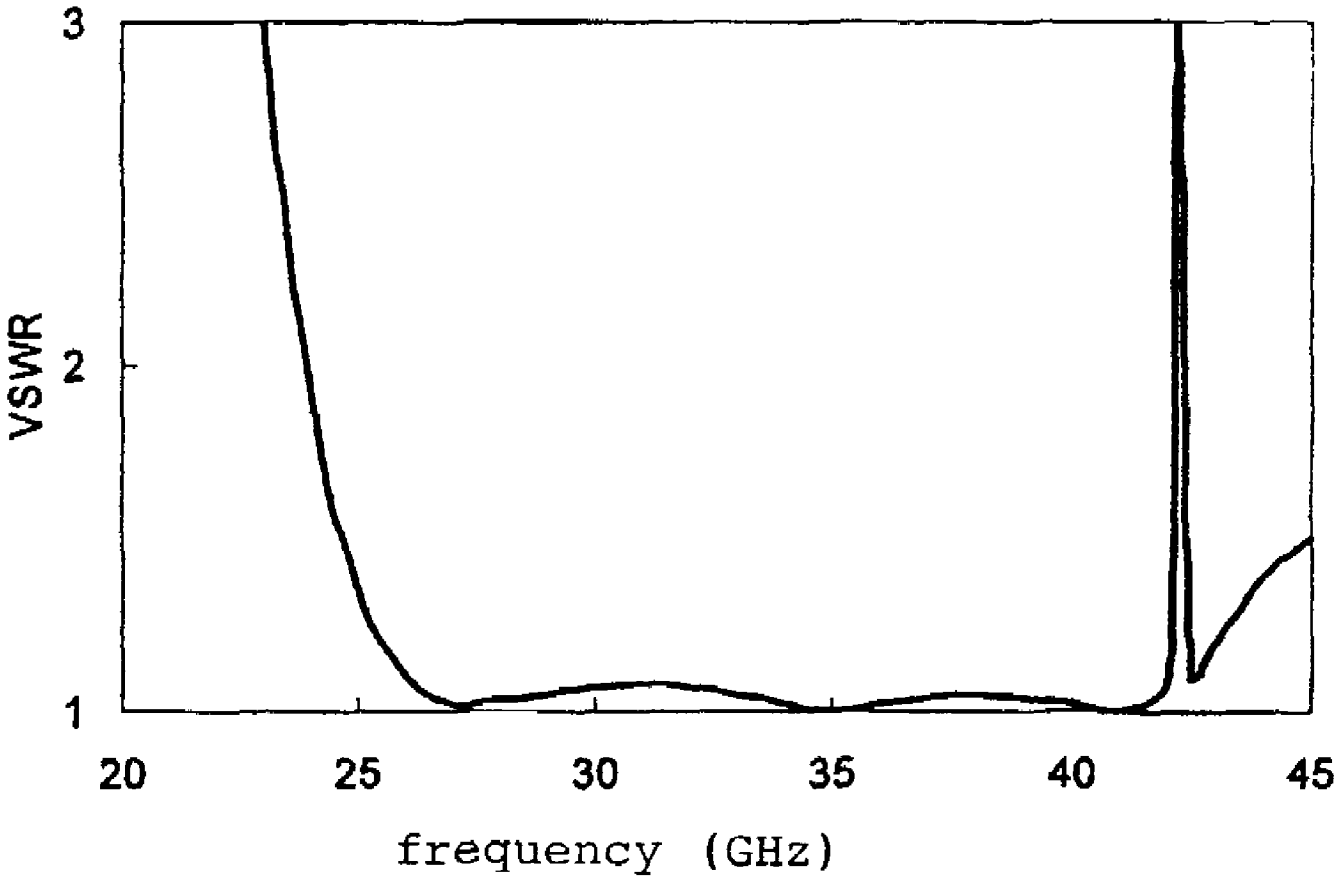
FIG. 7 is a graph for describing the VSWR characteristics of the pillbox vacuum window illustrated in FIGS. 5A and 5B.

FIG. 7 is a graph for describing the VSWR characteristics vs. frequency (in GHz) of the pillbox vacuum window of this embodiment.

In the configuration of the pillbox vacuum window according to this embodiment, the inner diameter of larger diameter cylindrical portion 3*a* which forms step section 3*c* of metal part 3, and the outer diameter of cylindrical portion 4*a* of metal part 4 are substantially the same as the outer diameter of ceramic disk 1, and cylindrical portion 4*a* of metal part 4 is inserted into step section 3*c* of metal part 3 while ceramic disk 1 is placed in step section 3*c* of metal part 3.

Consequently, the leak path, which extends along the length of portions of ceramic disk 1 and metal parts 3, 4 which are bonded to each other through metallization layer 2, can be shortened. Specifically, the leak path can be sized to have length L of 0.22 mm in the radial direction and length T of 0.22 mm in the thickness direction. In this way, metallization layer 2 can be sized to have a minimum length of 0.22 mm in the radial direction and a minimum length of 0.22 in the thickness direction as shown in FIG. 5A, and therefore the lengths can be reduced in the radial and thickness directions, thus making it possible to avoid resonance which would otherwise occur in a peripheral area of ceramic disk 1 within an available frequency band (26.5 to 40.0 GHz), as shown in FIG. 7.

Also, since the lengths of metallization layer 2 can be reduced in the radial and thickness directions, ceramic disk 1 need not be increased in diameter and thickness more than is necessary. This can reduce the proportion of dielectric material which occupies the overall pillbox vacuum window, leading to the avoidance of an increase in VSWR within the available frequency range, due to the influence of the dielectric material, as shown in FIG. 7.

As a result, stable VSWR characteristics can be achieved around a value of 1.18 or less within the available frequency range of the pillbox vacuum window.

Further, since the pillbox vacuum window of this embodiment is configured such that cylindrical portion 4*a* of metal part 4 is inserted into step section 3C of metal part 3 while ceramic disk 1 is placed in step section 3C of metal part 3, thin ceramic disk 1 can be fixed with high accuracy. In addition, since metal part 4 is also accurately inserted into metal part 3, an appropriate dimensional accuracy can be maintained for each part.

While preferred embodiments of the present invention have been described using specific terms, such description is for illustrative purposes only, and it is to be understood that changes and variations may be made without departing from the spirit or scope of the following claims.

What is claimed is:

1. A pillbox vacuum window for use in a microwave tube as input/output windows, comprising:

a ceramic disk having a metallization layer formed in a peripheral area thereof;

a first metal part including a larger diameter cylindrical portion, and a smaller diameter cylindrical portion having an inner diameter smaller than that of said larger diameter cylindrical portion, and coupled to said larger diameter cylindrical portion to form a step section at a joint, said ceramic disk being fitted into the step section; and a second metal part including a cylindrical portion being inserted into the step section of said first metal part while said ceramic disk is placed in the step section of said first metal part, wherein said larger diameter cylindrical portion of said first metal part has an inner diameter substantially identical to the outer diameter of said ceramic disk.

2. The pillbox vacuum window for use in a microwave tube as input/output windows of claim 1, wherein:

the second metal part is bonded to the ceramic disk by brazing through the metallization layer.

3. The pillbox vacuum window according to claim 1, wherein said cylindrical portion of said second metal part has an outer diameter substantially identical to the outer diameter of said ceramic disk.

4. A method of manufacturing a pillbox vacuum window for use in a microwave tube as input/output windows, comprising:

providing a first metal part which includes a larger diameter cylindrical portion having an inner diameter substantially identical to the outer diameter of a ceramic disk formed with a metallization layer in a peripheral area thereof, and a smaller diameter cylindrical portion having an inner diameter smaller than that of said larger diameter cylindrical portion, and coupled to said larger diameter cylindrical portion to form a step section at a joint;

providing a second metal part which includes a cylindrical portion having an outer diameter substantially identical to the outer diameter of said ceramic disk; and inserting the cylindrical portion of said second metal part into the step section of said first metal part so as to sandwich said ceramic disk.

5. The method according to claim 4, wherein said inserting the cylindrical portion of said second metal part into the step section of said first metal part comprises:

fitting said ceramic disk into the step section of said first metal part; and bonding said ceramic disk to said first metal part.

6. The method according to claim 5, wherein:

said bonding said ceramic disk to said first metal part is by brazing through said metallization layer.

7. The method according to claim 4, wherein said inserting the cylindrical portion of said second metal part into the step section of said first metal part comprises:

inserting the cylindrical portion of said second metal part into the step section of said first metal part; and bonding said second metal part to said ceramic disk.

8. The method according to claim 7, wherein:

said bonding said second metal part to said ceramic disk is by brazing through said metallization layer.

9. A pillbox vacuum window for use in a microwave tube as input/output windows, comprising:

a ceramic disk having a metallization layer formed in a peripheral area thereof;

a first metal part including a larger diameter cylindrical portion, and a smaller diameter cylindrical portion having an inner diameter smaller than that of said larger diameter cylindrical portion, and coupled to said larger diameter cylindrical portion to form a step section at a joint, said ceramic disk being fitted into the step section; and a second metal part including a cylindrical portion being inserted into the step section of said first metal part while said ceramic disk is placed in the step section of said first metal part, wherein a voltage standing wave ratio of the pillbox vacuum window is 1.18 or less within an available frequency range.

10. The pillbox vacuum window for use in a microwave tube as input/output windows of claim 9, wherein:

the available frequency range is 26.5 to 40.0 GHz.

* * * * *